United States Patent [19]

Cooper

[11] Patent Number: 4,841,821

[45] Date of Patent: Jun. 27, 1989

[54] J-NUT PLIER

[76] Inventor: Kenneth L. Cooper, c/o M. Graham, P.O. Box 8997, Savannah, Ga. 31412

[21] Appl. No.: 94,449

[22] Filed: Sep. 9, 1987

[51] Int. Cl.[4] ..... B25B 7/02

[52] U.S. Cl. ..... 81/426; 81/420; 29/247

[58] Field of Search ..... 81/426, 418, 420, 424.5; 29/268, 247, 248, 243.56

[56] References Cited

U.S. PATENT DOCUMENTS 1,649,513 11/1927 Dandeneau ..... 29/248
2,220,317 9/1939 Cynoske ..... 81/426
3,314,320 10/1965 Early ..... 29/268
3,934,286 1/1976 Metzinger ..... 29/268

*Primary Examiner*—Frederick R. Schmidt
*Assistant Examiner*—Lawrence Cruz
*Attorney, Agent, or Firm*—Cushman, Darby & Cushman

[57] ABSTRACT

A device for engaging and prying open J-nut clips of various shapes and sizes from a locked position on an automobile body part to permit easy removal thereof without damaging the same. The device having first and second handle members pivotally coupled together. The distal end of the first handle member having a U-shaped gripping member and the distal end of the second member having an upwardly extending portion for gripping and prying apart a J-nut clip.

3 Claims, 3 Drawing Sheets

J-NUT PLIER

FIELD OF THE INVENTION

The present invention relates to a device for removing J-nut clips from various automobile body parts, and for readjustment of such J-nut clips for re-attachment to said body parts.

BACKGROUND OF THE INVENTION

In the business industry of paint and body repair of automobiles, there is a clip known as a J-nut clip which is used almost universally to attach various automobile body parts to other body parts or to the main body of the automobile. For example, J-nut clips are used on headlight mounting panels, inner fender wells, bumper reinforcements, fenders, inner skirts and hoods, among others. This J-nut clip comes in various sizes, but is quite prevalent throughout the automobile industry and used by nearly every major automobile produceT.

At the present time, there is no suitable device with which to remove these J-nut clips from any automobile parts. Paint and body mechanics are now using various tools, such as, for example, a screwdriver, each of which takes a considerable amount of time and dexterity in order to remove any such J-nut clip. Moreover, the removal tools and techniques presently being used tend to damage the J-nut clips, often resulting in their unnecessary replacement.

One object of the present invention is to provide a device that will quickly and easily remove these J-nut clips, no matter what size the clip, in such a way as to reduce the potential for damage to the clip, and at the same time provide for reduced labor time in the automobile repair industry.

SUMMARY OF THE PRESENT INVENTON

The preferred exemplary embodiment of the present invention includes a gripping head which could be formed as a part of or separately attached to the end parts of the handle members similar, for example, to those of an ordinary pair of pliers, which are hinged together in a scissors like fashion by use of any conventional means, such as, for example, a dowel. The hinged handle members can be curved, as in a ordinary pair of pliers, or alternatively take on any number of other configurations and shapes. The gripping head is provided at the other ends of the hinged handle members and is comprised of two sections as follows.

The first section is forged or otherwise shaped into a bluntly pointed shaft which narrows or tapers uniformly as one proceeds away from the handle member, the other end portion of which is bent or otherwise shaped as so to form together with the rear portion of the shaft a slight or shallow "V" shape section that will cooperate with the other part of the gripping head.

The second or other gripping head section is forged or otherwise formed or attached at the distal end of a second shaft shaped similar to the shaft of the first gripping head section but not as long as the first shaft. The end of the second shaft includes a U-shaped clip engaging member which is positioned preferably at an angle of 90° to the axis of the second shaft. In operation, the V-shaped end of the first gripping section is placed on the closed end of a J-nut clip, while the U-shaped end of the other gripping section is positioned so that a free outer end of the said U-shaped gripping member is directly opposite the open end of a J-nut clip. As the handle members are squeezed together, the free outer end of the U-shaped section slides into the open end of the J-nut clip and continued closing of the handles pries the otherwise previously snapped together components apart, thereby allowing the J-nut clip, now held by the gripping members, to be slipped easily from the automobile body part.

With the foregoing in mind, other objects, features and advantages of the present invention will become more apparent upon consideration of the following description and the appended claims with reference to the accompanying drawings, all of which form part of this specification, wherein like reference numerals designate corresponding parts and various figures.

DESCRIPTION OF THE PREFERRED EXEMPLARY EMBODIMENT

Figure 1:
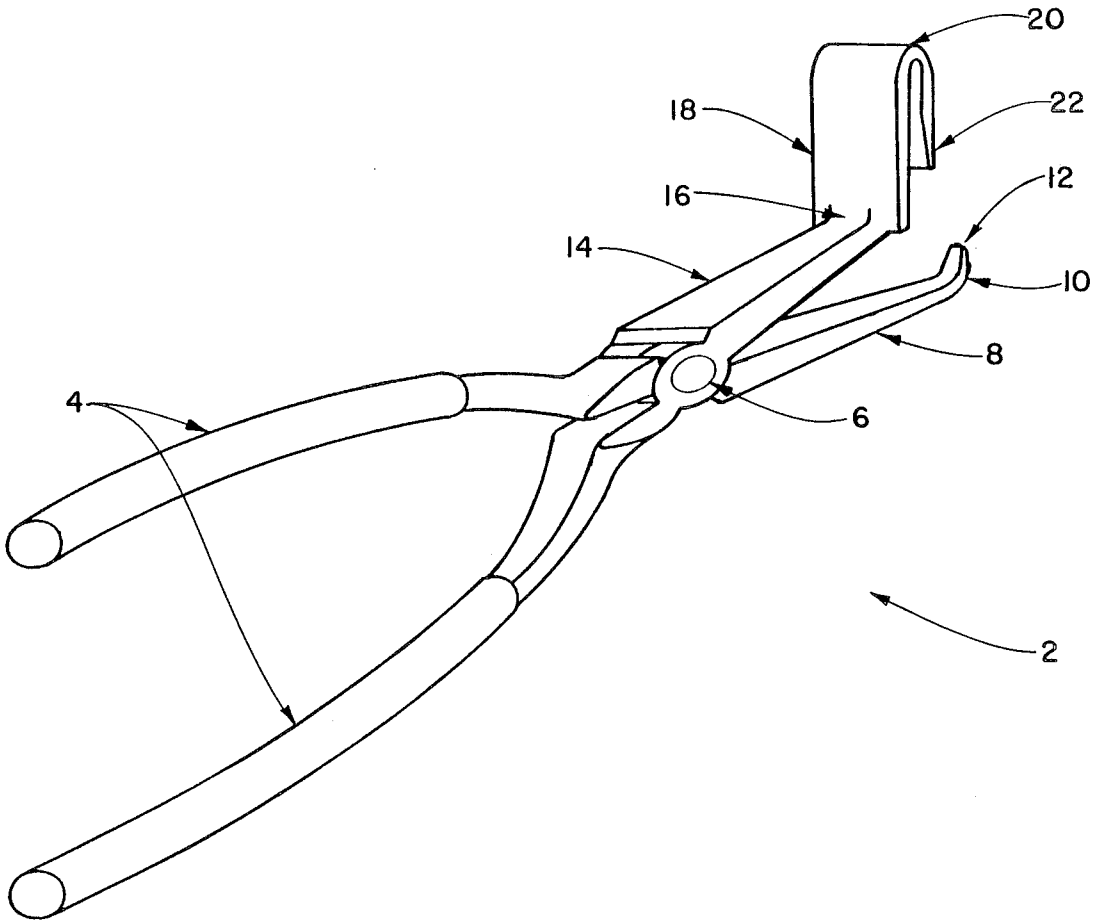
FIG. 1 is a perspective view of the device including the gripping head and the handle members hinged together.
Figure 2:
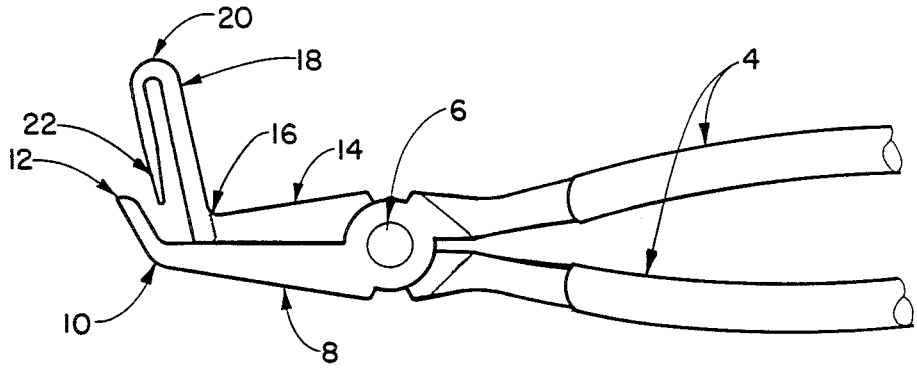
FIG. 2 is a side elevational view showing the device fully closed.

Turning first to FIG. 1, the exemplary embodiment of my present invention is shown generally at 2 and is comprised of a pair of handles 4 hinged together as at 6. The handles have forwardly extending portions that define two gripping sections generally indicated at 8 and 14. The first section 8 of the gripping head has a bluntly pointed shaft which narrows or tapers uniformly as one proceeds toward the gripping end, which shaft at 10 curves upward forming a shallow "V" shape section at 8-10-12 which cooperates with the other part of the gripping head. The second section of the gripping head begins with a shaft 14, similar to the first section, which shaft uniformly narrows until at 16 such shaft suddenly widens and extends upward almost at a right angle to the axis of the original shaft along a flat rectangular shaped member 18 which is then folded over on itself as at 20 so as to extend back along but spaced outwardly from the first portion of member 18 to form a substantially U-shaped gripping head member, the inner surface of which slopes outwardly to form a wedge shaped free outer end as shown at 22.

A typical J-nut clip is shown in FIGS. 4, 5, 6 and 7. Such a clip is fitted onto, for example, a fender well by sliding the clip over the bottom of the fender well so that the fender well fits between the sides 36 and 37 of the clip. As the fender well slides toward the bottom of the clip at 34, the setting lip 38 is pressed flat until the clip is all the way on, at which time the setting clip 38 springs back locking into place into a hole in the fender well. A bolt can then be used to attach, for example, an inner skirt to the fender well by inserting the bolt through the shaft 30 of the J-nut clip.

Figure 3:
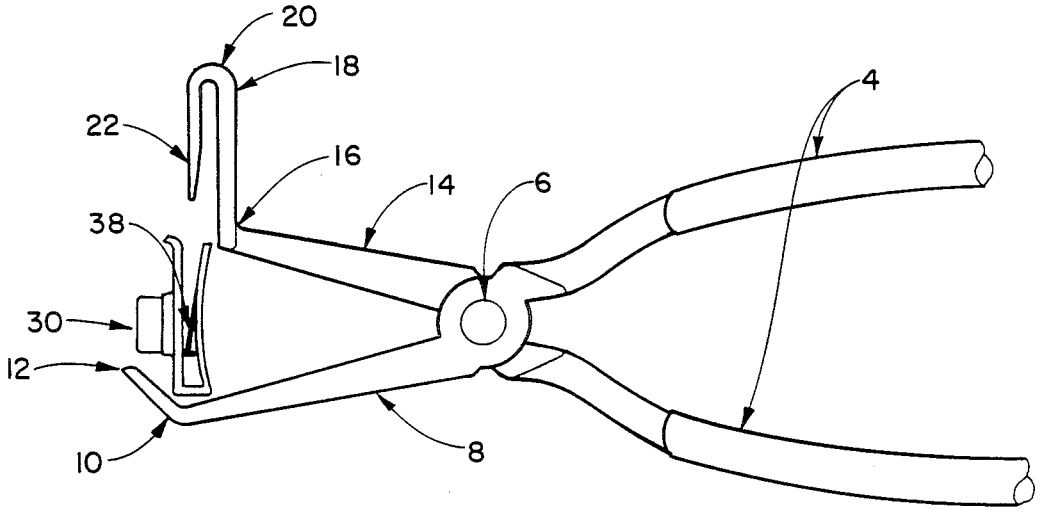
FIG. 3 is a side elevational view of the device shown fully opened with a J-nut clip positioned between the gripping head sections just prior to engagement.
Figure 4:
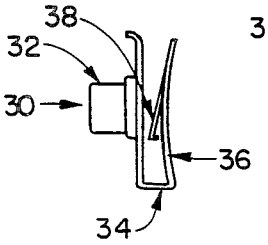
FIG. 4 is a side elevational view of a J-nut clip.
Figure 5:
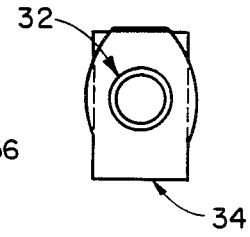
FIG. 5 is a front elevational view of a J-nut clip.
Figure 6:
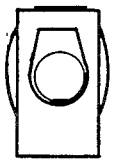
FIG. 6 is a back elevational view of a J-nut clip.
Figure 7:
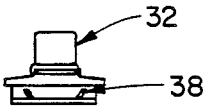
FIG. 7 is an top plan view of a J-nut clip.
Figure 8:
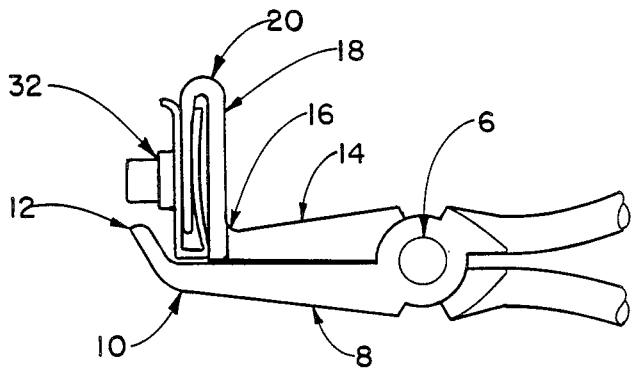
FIG. 8 is a side elevational view of the device showing the gripping ends closed about a J-nut clip; and, FIG. 9 is a side elevational view of the device showing a J-nut clip positioned for readjustment by the gripping device.

FIGS. 3 and 8 illustrate how the device works to remove the J-nut clip. The V-shaped gripping end at 10 is placed at the bottom 34 of the J-nut clip, while the U-shaped gripping end 18, 20 and 22 is positioned above the J-nut clip (inside the fender well). As the handle members at 4 are squeezed together, the shaft 22 slides between the walls 36 and 37 of the J-nut clip, prying the setting lip 38 from its locking position in the hole of the fender well, as shown in FIG. 8. A downward pull then easily removes the J-nut clip without damage.

Figure 9:
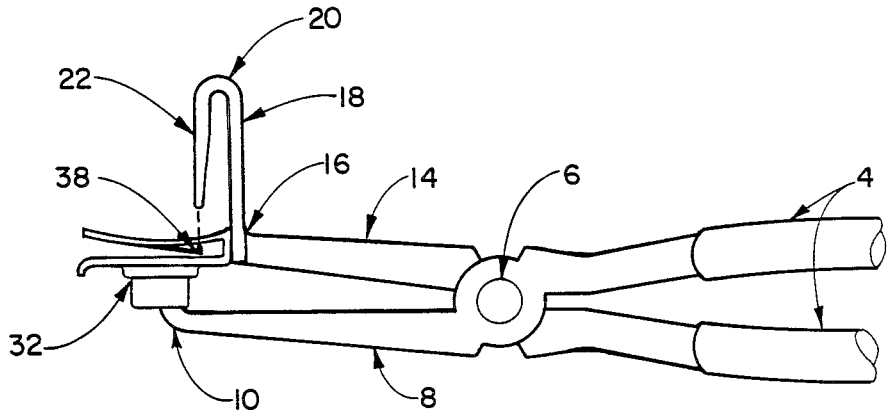

FIG. 9 illustrates how the device can be used to reset the setting lip 38 so that the J-nut clip can be used repeatedly. After repeated removals, the setting lip 38 flattens and must be reshaped. By inserting the end 12 of the gripping member 8 into the opening 30 of the J-nut clip, while the end 34 of the clip rests against the inside of the U-shaped gripping member at 16, the handle members 4 are squeezed together and, as the end 34 of the clip slides up the inside of the gripping member shaft 18, the end 22 of the U-shaped gripping member presses down on the setting lip 38 of the clip, bending it back into its original shape.

The gripping member shaft 8 and 14 and the gripping members at 10-12 and 18-20-22 are preferably forged from steel (either as a one-piece unit or separately forged pieces welded together), but other metals or combinations thereof could be used. Further, the gripping members could be provided with straight handle members, or most any other shape.

While the invention has been described in accordance with what is presently conceived to be the most practical and preferred embodiment, it is to be understood that the invention is not to be limited to the disclosed embodiment but on the contrary, is intended to cover various modifications and equivalent arrangements included within the spirit and the scope of the appended claims, which scope is to be accorded the broadest interpretation of such claims so as to encompass all such equivalent structures.

I claim:

1. A device for engaging and prying open J-nut clips of various shapes and sizes from a locked position on a automobile body part to permit easy removal thereof without damaging the same, said J-nut clips having an open end and a closed end, said device comprising:

first and second handle members, each said handle member having a proximal portion and a distal portion, each said distal portion having a longitudinal axis, said handle members being pivotally coupled together at a point intermediate said proximal and distal portions such that movement of said proximal portions from a spaced apart relation to an adjacent relation effects movement of the distal portions of said handle members from a spaced apart relation to an adjacent relation;

said distal portion of said first handle member having a downwardly open U-shaped gripping member defined at a distalmost end thereof, said U-shaped gripping member consisting essentially of first and second legs defined in a vertical plane extending through said longitudinal axis of said distal portion of said first handle member, said first and second legs being spaced apart along said longitudinal axis of said distal portion of said first handle member and each having a longitudinal axis disposed substantially perpendicularly to said longitudinal axis of said distal portion of first handle member such that the opening of the U-shaped gripping member is in facing relation to said distal portion of said second handle member;

said distal portion of said second handle member having at least one upwardly extending distalmost end portion, said distalmost end portion having a longitudinal axis disposed at an obtuse angle relative to said longitudinal axis disposed at an obtuse angle relative to said longitudinal axis of said distal portion of said second handle member;

whereby, when said handle members are pivoted about said pivotal coupling so that said distal portions are adjacent one another, a J-nut clip can be supported at its closed end on the angled distalmost end portion of said second handle member and a leg of said U-shaped gripping member can be slipped into the open end of said J-nut clip and pry apart the walls thereof.

2. A device for removing J-nut clips as set forth in claim 1, wherein solely one upwardly extending distalmost end portion is defined on said second handle member.

3. A device for engaging and prying open J-nut clips of various shapes and sizes from a locked position on an automobile body part to permit easy removal thereof without damaging the same, said J-nut clips having an open end and a closed end, said device comprising:

a first and second handle members, each said handle member having a proximal portion and a distal portion, each said distal portion having a longitudinal axis, said handle members being pivotally coupled together at a point intermediate said proximal and distal portions such that movement of said proximal portions from a spaced apart relation to an adjacent relation effects movement of the distal portions of said handle members from a spaced apart relation to an adjacent relation;

said distal portion of said first handle member having a downwardly open U-shaped gripping member defined at a distalmost end thereof, said U-shaped gripping member consisting essentially of first and second legs defined in a vertical plane extending through said longitudinal axis of said distal portion of said first handle member, said first and second legs being spaced apart along said longitudinal axis of said distal portion of said first handle member such that an opening of the U-shaped gripping member defined between said first and second legs is in facing relation to said distal portion of said second handle member;

said distal portion of said second handle member having a single upwardly extending distalmost end portion, said distalmost end portion having a longitudial axis disposed at an obtuse angle relative to said longitudinal axis of said distal portion of said second handle member;

whereby, when said handle members are pivoted about said pivotal coupling so that said distal portions are adjacent one another, a J-nut clip can be supported at its closed end on the angled distalmost end portion of said second handle member and a leg of said U-shape gripping member can be slipped into the open end of said J-nut clip and pry apart the walls thereof.

* * * * *